United States Patent [19]

Fuchs et al.

[11] Patent Number: 4,592,067

[45] Date of Patent: May 27, 1986

[54] METALLURGICAL VESSEL, IN PARTICULAR AN ELECTRIC ARC FURNACE

[75] Inventors: Gerhard Fuchs, Kehl-Bodersweier; Joachim Ehle, Lautenbach; Hans-Peter Heinzelmann, Rheinau-Diersheim, all of Fed. Rep. of Germany

[73] Assignee: Fuchs Systemtechnik GmbH, Willstatt-Legelshurst, Fed. Rep. of Germany

[21] Appl. No.: 642,791

[22] Filed: Aug. 21, 1984

[30] Foreign Application Priority Data

Feb. 21, 1984 [DE] Fed. Rep. of Germany ..... 3406130

[51] Int. Cl.[4] ..... F27D 3/14

[52] U.S. Cl. ..... 373/83; 222/598

[58] Field of Search ..... 373/83, 84; 222/591, 222/597, 598, 599, 600, 601; 266/236, 240, 245, 271

[56] References Cited

U.S. PATENT DOCUMENTS 4,298,147 11/1981 Honda et al. ..... 222/601

*Primary Examiner*—Roy N. Envall, Jr.

[57] ABSTRACT

Electric arc furnace, having a tapping hole (2) in the bottom of the vessel or in the bottom of a part (1) of the vessel, which projects in a bay window-like manner, and a closure arrangement (3) for the tapping hole (2), comprising a closure plate (4) which is movable from a closure position of closing the tapping hole from the outside into an open position of opening the tapping hole, by means of a first lever (6) which is pivotally mounted to the outside of the vessel (pivot axis 11) and which is pivotal by a drive means (14), whereby the closure plate (4) is mounted to an arm (5) which is connected rotatably (rotary axis 8) to the first pivotal lever (6) and which is guided by means of a second pivotal lever (7) which at a spacing from the first lever (6) on the one hand is pivotally connected to the outside of the vessel (pivot axis 12) and on the other hand is connected rotatably (rotary axis 9) to the arm (5).

13 Claims, 9 Drawing Figures

METALLURGICAL VESSEL, IN PARTICULAR AN ELECTRIC ARC FURNACE

DESCRIPTION

Figure 1:
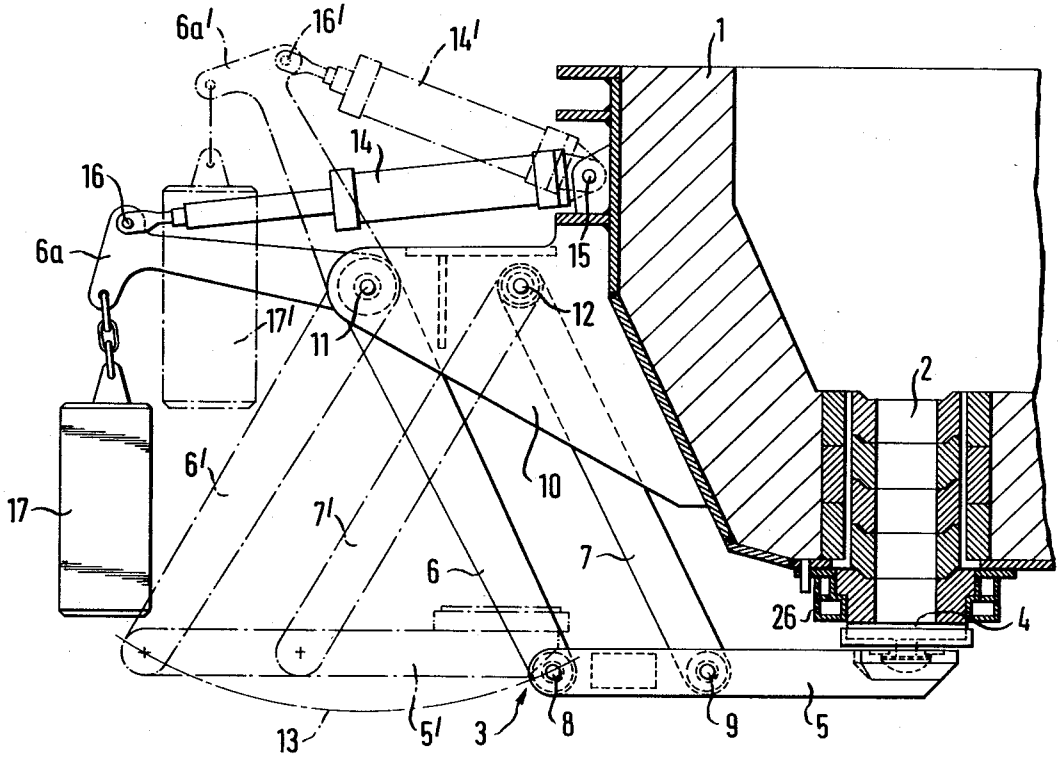

The invention relates to a metallurgical vessel, in particular an electric arc furnace.

Vessels of that kind are disclosed for example in British patent specification No. 812 216, Radex-Rundschau, issue 3, 1980, pages 187 to 196 and Stahl und Eisen 104 (1984), No 1, pages 7 to 10.

In the metallurgical vessel disclosed in British patent specification No. 812 216, the tapping hole is closed by a closure plate which can be pivoted laterally by means of a pivotal lever mounted on a perpendicular shaft. That system does not ensure the required degree of reliability, when tapping off molten steel, and requires extensive maintenance operations.

In the case of the metallurgical vessels which are disclosed in the other two publications referred to above, the closure apparatus includes a closure plate which is mounted on a pivotal lever. The lever is secured to a horizontally disposed rotary shaft which can be rotated over a predetermined angular range by means of a drive arrangement. In that system, the pivotal movement of the closure plate is nct in a horizontal plane, as in the system disclosed in British No. 812 216, but in a vertical plane. Therefore, depending on the length of the pivotal lever, a greater or smaller distance must be provided between the tapping hole of the metallurgical vessel and the ladle or mould into which the liquid metal is poured. In addition, with that system, it is difficult to screen the closure arrangement from the heat radiated by the molten material which is tapped off.

The invention is based on the object of providing a metallurgical vessel, wherein the closure arrangement which is associated with the tapping hole operates reliably while nonetheless requiring little space in the region underneath the tapping hole. The invention seeks to provide that the closure arrangement is better protected from the heat radiated by the liquid metal tapped off, and can be screened in a simple manner.

This and other objects are achieved by the present invention as more fully described hereinafter.

In the construction in accordance with the invention, the closure plate is mounted on a substantially horizontally disposed arm which is connected to two spaced-apart pivotal levers which are pivotally connected at a spacing from each other to the outside of the metallurgical vessel. The axes of rotation of those levers, connecting them to the arm carrying the closure plate, and the two pivot axes, are disposed at the corners of a quadrilateral, preferably a parallelogram, for defining the movement of the arm when the levers move with a pivotal motion. Depending on the geometry of the quadrilateral or parallelogram, in the operation of opening the tapping hole, the closure plate is withdrawn laterally by means of the arm, with only a slight downward movement, and raised to a greater or lesser extent, outside the metallurgical vessel, depending on the magnitude of the pivotal movement. That means that not only is the amount of space required underneath the tapping hole reduced to a minimum, but in addition the mechanism which is sensitive to radiant heat is also removed from the direct area of influence of the liquid metal which is tapped off. In addition, it is possible to provide a housing which, in the open condition of the closure apparatus, is closed by a cover or masking plate which is mounted to the underside of the arm that carries the closure plate.

By virtue of the lateral opening movement of the closure plate when tapping off the metallurgical vessel, any solidified metal bridges between the tapping hole and the closure plate are substantially subjected to a shear loading and are thus easily broken away. As, in the opening and closing movements, the closure plate is not pivoted precisely in a horizontal plane, this arrangement ensures that the plate can still be pressed adequately against the edge of the tapping opening, even when wear has occurred. That effect is improved by mounting the closure plate by way of a ball joint on the arm carrying the closure plate.

Figure 2:
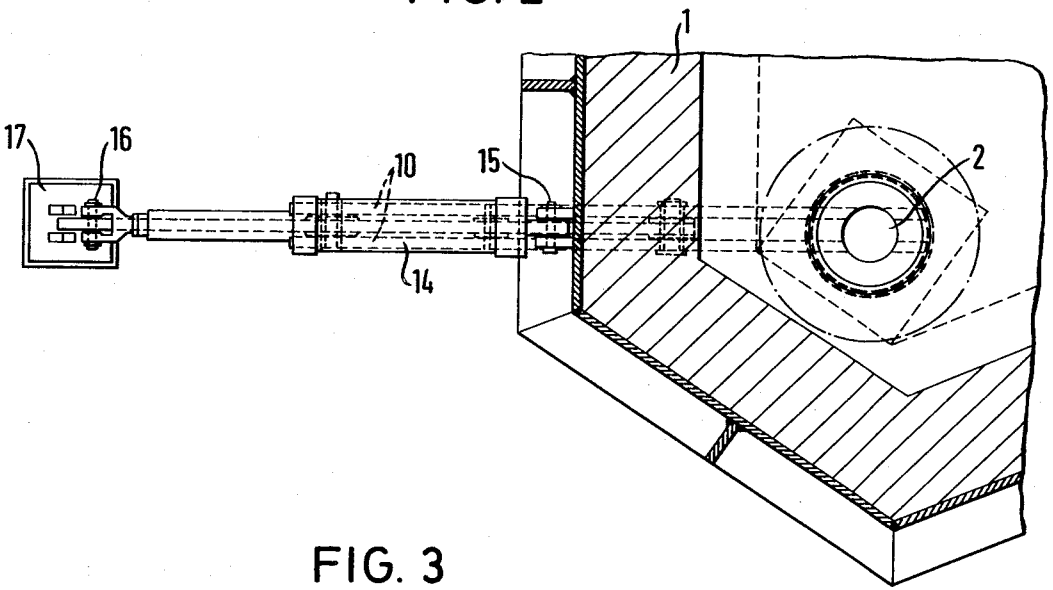
Figure 3:
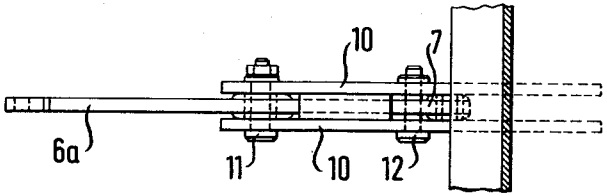
Figure 4:
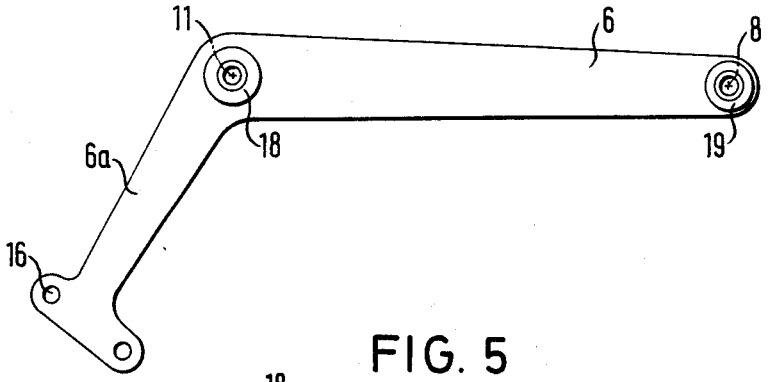
Figure 5:
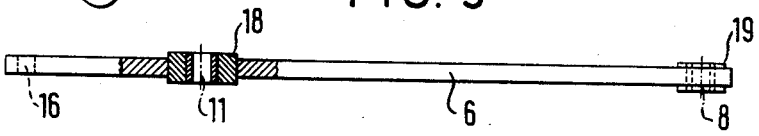
Figure 6:
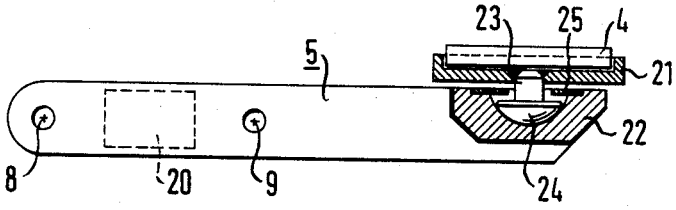
Figure 7:
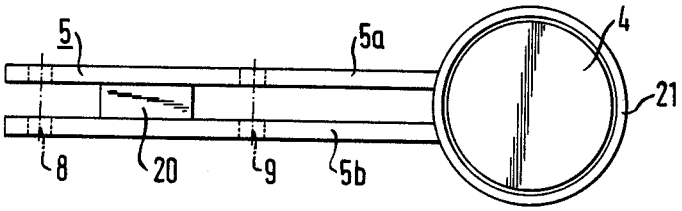
Figure 9:
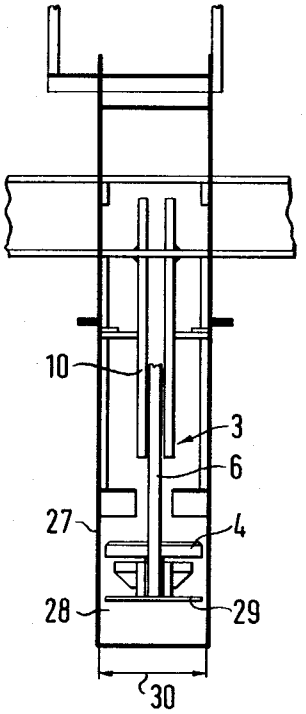
Figure 8:
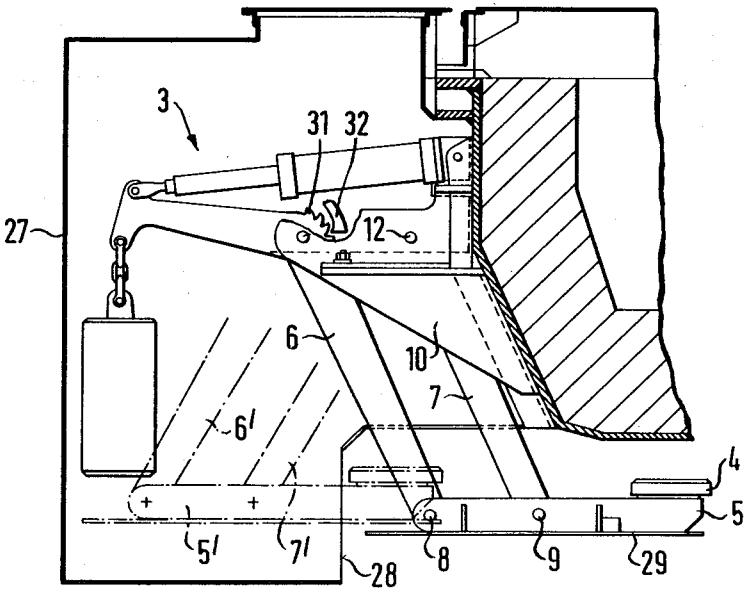

The invention will be described in greater detail by means of an embodiment, with reference to nine figures of drawings in which:

FIG. 1 is a partly sectional side view of the part, that includes the tapping opening, of a metallurgical vessel, with the associated closure arrangement, FIG. 2 shows a plan view of the part of the metallurgical vessel shown in FIG. 1, including the closure arrangement, FIG. 3 is a plan view of the arrangement of the two pivot axes of the pivotal levers, FIGS. 4 and 5 are a side view and a plan view of the first driven pivotal lever, FIGS. 6 and 7 are a side view and a plan view of the arm with the closure plate, and FIGS. 8 and 9 are two side views showing the screening of the closure arrangement by means of a housing.

The metallurgical vessel of which part is shown in section in FIGS. 1 and 2 is an electric arc furnace having a part 1 which projects in the manner of a bay window, being of trapezoidal configuration in cross-section (see FIG. 2). Disposed in the bottom of that part 1 of the vessel is a tapping hole 2 with which a closure arrangement 3 is associated. The closure arrangement includes a closure plate 4 which is pivotally mounted to an arm 5. The arm 5 is rotatably connected to a first pivotal lever 6 and a second pivotal lever 7. The axes of rotation of those levers, connecting them to the arm 5, are disposed at a spacing from each other and are denoted by reference numerals 8 and 9 respectively. Welded to the outside of the projecting part 1 of the metallurgical vessel, more specifically, in this case, to the side wall of that part of the vessel, is a double plate assembly 10 (FIGS. 1 and 3) in which the pivotal levers 6 and 7 are pivotally mounted. The pivot axes of the levers 6 and 7, like the above-mentioned axes 8 and 9, are disposed at a spacing from each other, and are denoted by reference numerals 11 and 12 respectively. In the construction illustrated, the plate assembly 10 with the pivot axes 11 and 12 is mounted to one of the two converging sides of the trapezoidal configuration.

The pivot axes 11 and 12 of the pivotal levers 6 and 7, which are stationary with respect to the furnace vessel, as well as the axes 8 and 9 of the levers 6 and 7 connecting them to the arm 5 are arranged at the corners of a quadrilateral, more particularly, in the illustrated construction, at the corners of a parallelogram. In that way, upon pivotal movement of the levers 6 and 7, the arm is displaced parallel to itself, more specifically, along an arcuate path 13, from the closed position shown in solid lines in FIG. 1 into an open or release position shown in dash-dotted lines. In the open position, the reference numerals denoting the respective components are each provided with a prime.

If the pivot axes 11 and 12 and the rotary axes 8 and 9 are not disposed at the corners of a parallelogram but at the corners of an irregular quadrilateral, then that geometrical configuration makes it possible to produce other desired movements in opening and closing the closure arrangement.

In the construction illustrated, associated with the first lever 6 is a drive means 14 while the second lever 7 only serves to guide the arm 5. The drive means 14 is in the form of a double-acting thrust motor, preferably a pneumatically actuated thrust motor. It is pivotally mounted on the one hand to a location 15 on the outside of the part 1 of the vessel and on the other hand is rotatably connected to a portion 6*a* of the lever 6, which is extended beyond the pivot axis 11. The rotary axis connecting the motor to the extended portion 6*a* is denoted by reference numeral 16. The extended portion 6*a* of the lever 6 is bent over outwardly relative to the part 1 of the vessel, in relation to the remaining part of the lever 6, and is loaded by a weight 17 at the end which is adjacent to the axis 16. The weight 17 is of such a size that, in the event of failure of the motor 14, the closure arrangement is moved into the closure position, that is to say, the closure arrangement is biased in the direction of closure thereof and the tapping hole 2 is thus closed by the closure plate 4 as long as the motor 14 is not being or cannot be operated.

FIG. 3 shows the closure arrangement from above, with the drive means 14 and the weight 17 removed. FIG. 3 serves in particular to show the mounting of the pivotal levers 6 and 7 within a double plate assembly 10 and to show the pivot axes 11 and 12 of the levers 6 and 7. The pivot axes 11 and 12 are formed by rotary pins which engage into bores in the levers 6 and 7.

FIGS. 4 and 5 show a partly sectional side view and plan view respectively of the lever 6. It will be seen that eyes 18 and 19 are fitted into the lever in the region of the pivot axis 11 and the axis 8, in order to provide for better mounting of the lever. The second lever 7 is of a corresponding configuration.

FIGS. 6 and 7 show a side view and a plan view of the arm 5 that carries the closure plate 4. The arm 5 is in the form of a double arm and is connected to the levers 6 and 7 in the region of the rotary axes 8 and 9. The two portions 5*a* and 5*b* of the double arm 5 are held at the prescribed distance from each other by a spacer block 20. The axes 8 and 9, similarly to the pivot axes 11 and 12, are formed by rotary pins (not shown) which engage into the bores in the levers 6 and 7.

The closure plate 4 is secured in a mounting plate 21 with an upwardly extended rim portion, for example by means of steel pins. The mounting plate 21 is connected to the arm 5 by way of a ball joint having a limited angle of movement. In the illustrated embodiment, the ball joint includes a hemispherical socket 22 which is mounted to the arm 5, and a pin 23 with a head 24 which is in the form of a portion of a sphere and which is mounted in the socket 22. The pin 23 carries the mounting plate 21. The head 24 of the pin 23 is retained in the socket 22 by a retaining plate 25. That form of connection between the closure plate 4 and the arm 5 ensures that, even when wear occurs, the closure plate can bear sealingly against the lower edge of the tapping hole. Moreover, as shown in FIG. 1, the lower edge of the tapping hole is formed by a nozzle brick or teeming nozzle member which is cooled by means of a cooling ring 26. The cooling ring and the nozzle brick can be easily replaced if required, similarly to the closure plate 4, which usually comprises graphite, in the mounting plate 21.

The above-described closure arrangement operates in the following manner:

If, with the closure arrangement in the closed position as shown in solid lines in FIG. 1, the double-acting pneumatic motor 14 is actuated in a direction such that the spacing between the pivot axis 15 and the rotary axis 16 is reduced, then that causes the lever 6 to be pivoted into the position 6' shown in dash-dotted lines, with the arm 5 being moved into the position 5' parallel to itself, by virtue of being guided by the arm 7, along the arcuate path of movement 13. Any bridge portions of solidified metal between the lower edge of the tapping hole 2 and the closure plate are broken away at the beginning of the movement. The reverse movement from the open position into the closure position is effected by reversing the drive means 14, that is to say, by increasing the distance between the pivot axis 15 and the rotary axis 16. The weight 17 also acts in that direction, the size of the weight 17 being such that, in the event of a failure in the drive means 14, the closure plate is moved in the closing direction by the weight, and is pressed against the tapping hole. The weight 17 is of such a size that the weight of the column of metal above the closure plate can also be supported.

The range of pivotal movement of the levers 6 and 7 can be increased in comparison with the construction shown in FIG. 1, if the pivot axis 15 of the drive means 14 is disposed at a higher level. That permits the heat-sensitive parts of the pivotal arrangement to be sufficiently far removed from the area of radiant heat of the tapped-off molten metal.

In a development of the invention as illustrated in FIGS. 8 and 9 however, it is also possible for the closure arrangement to be surrounded by a housing which is provided with an opening in its underside, with a masking or cover plate secured to the underneath of the arm 5; in the open position of the closure plate, the cover or masking plate covers the opening of the housing so that the closure arrangement is completely screened from the tapped-off molten metal.

In the two side views shown in FIGS. 8 and 9, the closure arrangement 3 is enclosed by a flat or shallow housing 27 which at its underside has an opening 28 through which the arm 5 can be retracted into the housing 27, on moving into the open position of the arrangement. Secured to the underside of the arm 5 is a cover or masking plate 29 which screens the joints of the rotary axes 8 and 9 from radiant heat from below, while at the same time closing the housing from below when the closure arrangement is in the open position. For that purpose, the width of the cover or masking plate 29 is somewhat smaller than the internal width 30 (see FIG. 9) of the housing 27.

Concerning the embodiment according to FIG. 8 part of the cutline of the pivotal lever 6 is provided with teeth 31 of a ratchet wheel and a pawl 32 engaging into the gaps between the theeth. By this mechanism the pivotal lever 6 is latched in the open position of the closure arrangement 3, so that, in the event of failure of the motor 14, the closure arrangement can be held in its open position, wherein the tapping hole 2 is opened. By an operating means, not shown in the fig., pawl 32 can be brought from its engaging position into a released position with the effect that the pivotal lever will also be released and can perform its closing movement.

We claim:

1. A metallurgical vessel comprising, a main body provided with a tapping hole in the bottom thereof, a closure plate movable between closed and open positions outside of said tapping hole, a substantially horizontal actuating area connected to said closure plate for effecting lateral movement of said plate, a first lever pivotally supported at a first axis member mounted on the outside of said vessel main body and rotatably connected at a second axis member to said actuating arm, drive means connected to said first lever for pivoting the same about said first axis member and through rotation of said first lever about said second axis member to cause said actuating arm to move laterally, a second lever pivotally supported at a third axis member mounted on the outside of said vessel main body and rotatably connected at a fourth axis member to said actuating arm, said second lever being spaced from said first lever to guide said actuating arm, said first and second levers forming part of a parallelgram with each of said four axes at a respective corner thereof.

2. A metallurgical vessel according to claim 1, wherein said first pivotal lever is extended beyond said first axis by a portion to which a thrust motor forming said drive means is rotatably connected, said motor being connected to the outside of said vessel main body.

3. A metallurgical vessel according to claim 2, wherein said extended portion is bent over outwardly with respect to said vessel, relative to the remaining part of said first lever.

4. A metallurgical vessel according to claim 3, wherein the end of said extended portion of said first pivotal lever is loaded by a weight.

5. A metallurgical vessel according to claim 1, wherein said first and second levers are pivotally connected to at least one plate which is secured to the outside of said vessel mainbody.

6. A metallurgical vessel according to claim 5, wherein the pivot axes of said first and second pivotal levers are disposed at a spacing from each other, substantially normal to the axis of said tapping hole, on a side wall of said vessel.

7. A metallurgical vessel according to claim 6, wherein the outside of part of said vessel mainbody projects in a bay window-like manner of trapezoidal configuration in cross-section and the pivot axes of said first and second levers are supported on one of two converging sides of said trapezoidal configuration.

8. A metallurgical vessel according to claim 2, wherein said thrust motor is a pneumatically actuated thrust motor which is operative in two directions.

9. A metallurgical vessel according to claim 1, wherein said closure plate is connected to said actuating arm by means of a ball joint with a limited angle of movement.

10. A metallurgical vessel according to claim 9, wherein said ball joint comprises a hemispherical socket mounted on said arm, a pin provided with a head in the form of a portion of a sphere is mounted in said socket, said pin carrying said closure plate.

11. A metallurgical vessel according to claim 9 or claim 10, wherein said closure plate is fixed in a mounting bracket having an upwardly extended rim portion, said mounting bracket being connected to said arm by way of said ball joint.

12. A metallurgical vessel according to claim 1, wherein the structure recited for moving said closure plate is enclosed by a housing which is provided at its underside with an opening through which said actuating arm can be at least partically retracted when in the open position of said closure plate.

13. A metallurgical vessel according to claim 12, wherein a screening plate is secured to the underside of said actuating arm to screen the same from radiant heat generated therebeneath.

* * * * *